US005517792A

United States Patent [19]

Champa et al.

[11] Patent Number: 5,517,792

[45] Date of Patent: May 21, 1996

[54] GUY-WIRE GUARD ASSEMBLY AND METHOD OF INSTALLING SAME

[75] Inventors: Raymond J. Champa, Chagrin Falls, Ohio; William G. Vlahos, Danville, Calif.

[73] Assignee: Preformed Line Products Company, Cleveland, Ohio

[21] Appl. No.: 298,196

[22] Filed: Aug. 31, 1994

[51] Int. Cl.[6] ..... E04H 12/20

[52] U.S. Cl. ..... 52/147; 411/510

[58] Field of Search ..... 52/147, 146, 148, 52/152; 411/510, 508, 41, 913; 16/126, 222

[56] References Cited

U.S. PATENT DOCUMENTS

| | | | |
|---|---|---|---|
| 3,494,244 | 2/1970 | Wayland . | |
| 3,782,059 | 1/1974 | Reed . | |
| 4,223,491 | 9/1980 | Vaughn | 52/147 |
| 4,345,848 | 8/1982 | Cheselka . | |
| 4,638,611 | 1/1987 | Vaughn . | |
| 4,962,620 | 10/1990 | Mastalski . | |
| 4,987,639 | 1/1991 | Baiuley et al. . | |

FOREIGN PATENT DOCUMENTS

| | | | |
|---|---|---|---|
| 40122 | of 1968 | Finland | 52/147 |

*Primary Examiner*—Carl D. Friedman
*Assistant Examiner*—David Jersen
*Attorney, Agent, or Firm*—Fay, Sharpe, Beall, Fagan, Minnich & McKee

[57] ABSTRACT

A guard assembly for use on a guy-wire of the type having an end terminating in a loop comprises an elongated tubular member of a relatively rigid plastic having a hollow interior throughout its length. The tubular member has a single split extending longitudinally thereof between the opposite ends thereof to allow the tubular member to be installed in surrounding relationship to a guy-wire by being moved laterally thereover with the guy-wire entering the hollow interior through the split. First and second generally diametrically opposed aligned apertures are located adjacent the first end of the tubular member so that they can be aligned with the loop on the guy-wire. An elongated pin-like fastener extends through the first aperture and has head portions at opposite ends with a first head portion located within the hollow interior of the tubular member and being radially compressible to a size to allow the head to be selectfully passed through the second aligned opening. A second head portion is of a sufficient size to prevent its passage through the aligned openings. Additionally, the first head portion has a tapered shape to facilitate its insertion through the loop in the guy-wire and through the second aligned opening to lock the tubular member in a guarding position on the guy-wire.

2 Claims, 2 Drawing Sheets

12
14
10
16

14
4
3
4
12a
3
16

GUY-WIRE GUARD ASSEMBLY AND METHOD OF INSTALLING SAME

BACKGROUND OF THE INVENTION

The subject invention is directed toward the art of guy-wire guard assemblies and fasteners therefor.

Guy-wires are commonly used for stabilizing utility poles, towers, antennas, and similar ground-supported tall structures. The guards are generally placed on the guy-wires in an attempt to provide an increased visual marking and to prevent or reduce injury from impact with the guy-wire.

The current typical guard assembly comprises various partially cylindrical plastic or metal assemblies of elongated structural members which are connected to the guy-wires by various mechanical fasteners. The guy-wires themselves come in a variety of differing sizes generally necessitating the provision of a wide range of different size fasteners and connecting members to allow the guard assemblies to be suitably mounted.

The various guard assemblies of the type generally referred to are shown in the following Reed U.S. Pat. No. 3,782,059 issued Jan. 1, 1974; Vaughn U.S. Pat. No. 4,638,611 issued Jan. 27, 1987; and, Mastalski U.S. Pat. No. 4,962,620 issued Oct. 16, 1990.

SUMMARY OF THE INVENTION

The subject invention provides an improved guard assembly and method of using the same which has a minimum number of parts and which can be installed rapidly without the use of tools. All elements of the assembly can preassemble into one easily installed structure.

In accordance with one aspect of the invention, there is provided a guy-wire and guard assembly combination that includes an elongated guy-wire extending under tension between first and second spaced points with the guy-wire terminating in a closed loop at the second point. An elongated tubular plastic guard member that is split throughout its length is positioned in surrounding relation to the guy-wire to extend longitudinal thereof with a first end portion of the guard member encircling a portion of the closed loop of the guy-wire at the second point. Aligned openings are formed through generally diametrically opposite points in the first end portion of the guard member and a pin member extends between the aligned openings in the guard member and through the closed loop and the guy-wire at the second point. Integral stop means are provided on the ends of the pin member to prevent withdrawal of the pin member from within the closed loop. At least one of the stop means constitutes an enlarged resilient head portion that is collapsed radially inward to allow manual insertion of the pin through the openings.

Preferably, and in accordance with a more limited aspect, the guard member has only a single longitudinally extending split with the portions of the tubular guide member adjacent the split being in overlapping relationship.

In accordance with a still more limited aspect of the invention, the pin means is preferably formed of plastic and there is a slot formed through the enlarged resilient head portions to facilitate their radial collapse. Additionally, there can be two or more enlarged head portions so that the assembly can be more suitably fitted to different guy-wire assemblies.

In accordance with another aspect of the invention, a guard assembly for use on a guy-wire of the type having an end terminating in a loop comprises an elongated tubular member of a relatively rigid plastic having a hollow interior throughout its length and terminating in first and second open opposite ends. The tubular member has a single split extending longitudinally thereof between the opposite ends to allow the tubular member to be installed in surrounding relationship to a guy-wire by being moved laterally thereover with the guy-wire entering the hollow interior through the split. First and second generally diametrically opposed aligned apertures are located adjacent the first end of the tubular member so that they can be aligned with the loop on the guy-wire. An elongated pin-like fastener extends through the first aperture and has first and second enlarged head portions at opposite ends thereof with the first head portion located within the hollow interior of the tubular member and being radially compressible to a size to allow the head to be selectfully passed through the second aligned opening. The second head portion is of a sufficient size to prevent its passage through the aligned openings. Additionally, the first head portion has a tapered shape to facilitate its insertion through the loop in the guy-wire and through the second aligned opening to lock the tubular member in a guarding position on the guy-wire.

In accordance with another aspect of the invention, the fastener is a molded plastic one-piece structure which the second head portion including a plurality of separate conically shaped portions with a longitudinally extending slot formed therethrough to facilitate collapse of the head during the installation operations.

Accordingly, a primary object of the present invention is the provision of a guard assembly which is extremely simple to use and requires a minimum number of parts.

A further object of the invention is a guard assembly of the type described which can be rapidly installed without the use of tools.

A still further is the provision of a guard assembly which can be installed using a single fastener.

Yet another object is the provision of a method of installing a guard to guy-wire that allows a single guard and fastener assembly to be used with a wide variety and different sizes of guy-wires.

BRIEF DESCRIPTION OF THE DRAWINGS

The above and other objects and advantages will become apparent from the following description when read in conjunction with the accompanying drawings wherein.

DETAILED DESCRIPTION OF THE PREFERRED AND ALTERNATE EMBODIMENTS

Figure 1:
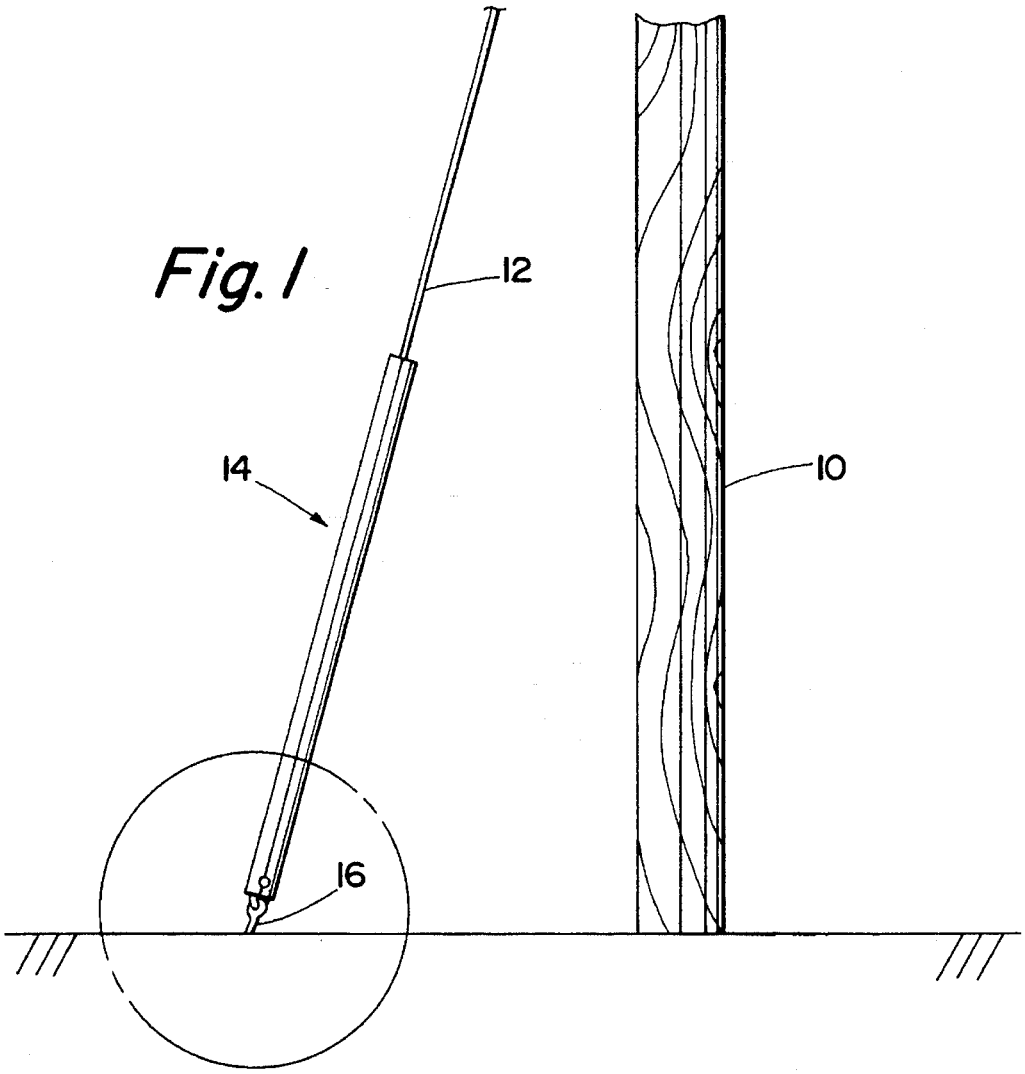
FIG. 1 is a side elevational view of a power pole and guy-wire assembly wherein the guy-wire is provided with a guard assembly formed in accordance with the subject invention.

Referring more particularly to the drawings wherein the showings are for the purpose of illustrating preferred and alternate embodiments of the invention only, and not for the purpose of limiting same, FIG. 1 shows a power pole 10 provided with a conventional guy-wire 12 having a guard assembly 14 formed in accordance with the preferred embodiment of the invention connected thereto. The guy-wire 12 is of typical construction and extends in tensioned relationship between a first upper end that is suitably connected to an elevated position on the power pole 10 and a lower end portion which has a loop connection with a typical ground anchor member 16. The guy-wire 12 is formed typically from a wire rope or cable and the loop portion of the guy-wire which extends through the ground anchor 16 can be formed merely by looping the lower end of the cable 12 through the ground anchor and then using cable clamps to join the looped end through or, alternatively, the loop can be formed by use of a separate strand terminating dead-end element.

Figure 2:
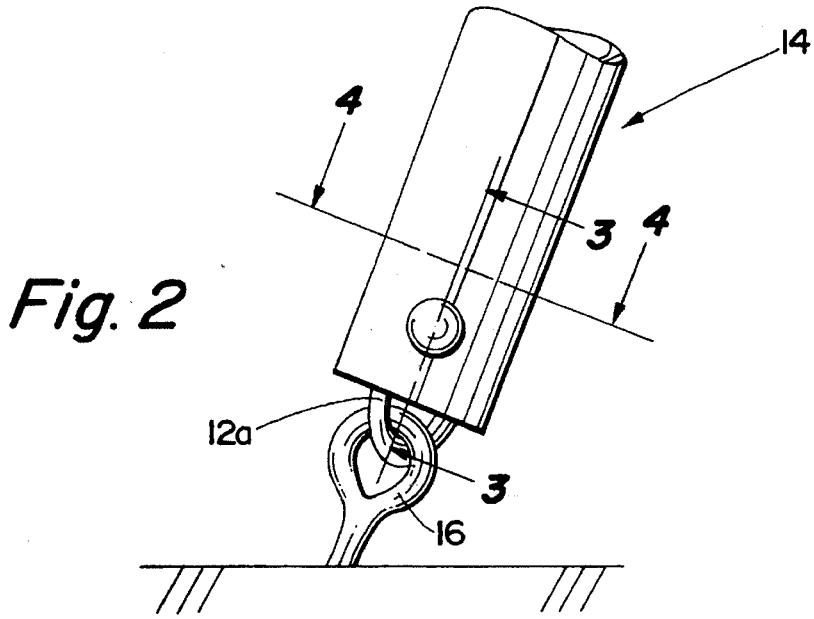
FIG. 2 is a greatly enlarged view of the circled portion of FIG. 1.
Figure 3:
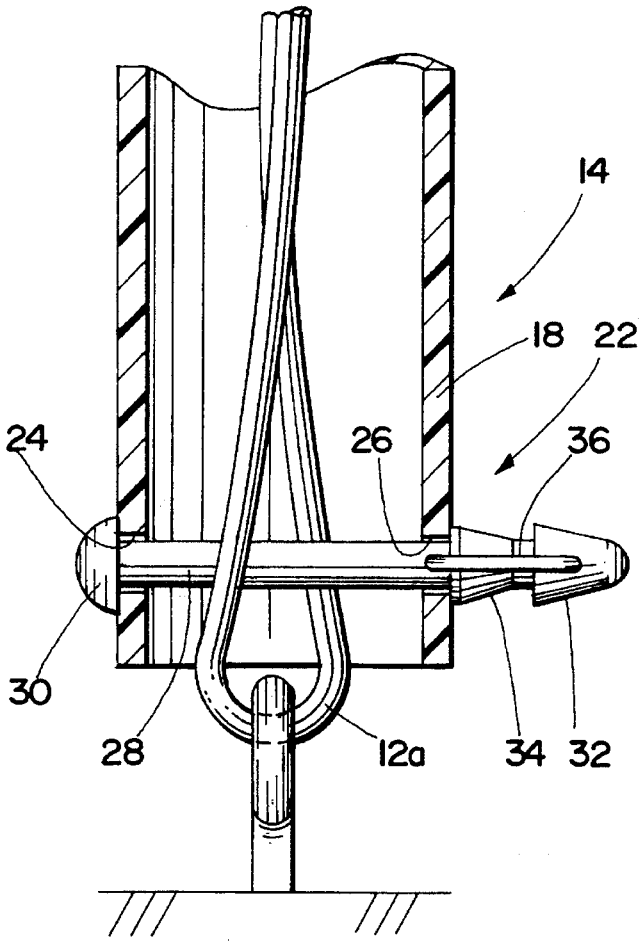
FIGS. 3 and 4 are cross-sectional views taken on lines 3—3 and 4—4 respectively of FIG. 2.
Figure 4:
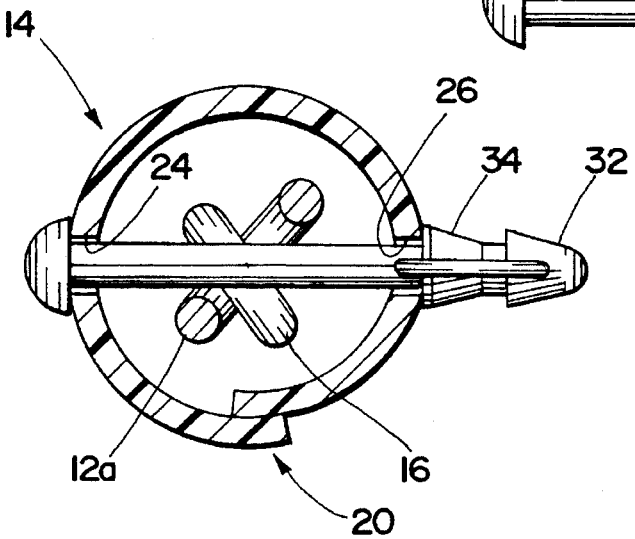

The arrangement and construction of the guy guard assembly 14 can best be understood by reference to FIGS. 2 through 4. As shown therein, the guard assembly is primarily constituted of an elongated tubular member 18 which is preferably formed from a suitable relatively rigid section of plastic tubing. Many different plastics could be used including high density polyethylene or any similar plastic having the necessary strength and rigidity to perform the necessary guard function. The tubular member 18 includes a longitudinally extending slit or groove 20 (see FIG. 4) that extends throughout the length of the tube from the exterior into the hollow interior. Normally, with extruded plastic tubing of the type considered for use herein, the formation of the slit 20 takes place after the tubing has been extruded and cooled. The internal stresses within the tubing cause the tubing to contract into the overlapped relationship shown in FIG. 4. That is, the portions of the tubing adjacent the longitudinally extending slit contract circumferentially into an overlapped and nearly sealed relationship. It is, of course, possible to form such an overlap by direct extrusion or by subsequent treatment of a previously extruded slit tube. In any event, the diameter of the tube 14 is such as to allow it to fully encircle and contain the guy-wire 12 and the lower loop portion 12*a* in the manner shown in FIGS. 2 through 4. The longitudinally extending slit allows the direct manual application of the tube about the guy-wire 12 and its loop portion 12*a*.

In order to maintain the tubular guard member 18 in the proper assembled position on the guy-wire and to retain it against undesired movement or removal, the assembly is provided with a locking fastener 22. As best seen in FIGS. 3 and 4, the fastener 22 extends through aligned openings 24 and 26 formed in diametrically opposed portions of the lower end of the tube 18. As seen in FIG. 4, the openings 24, 26 are preferably located at points rotated 90° from the slit 20. Additionally, as seen in FIG. 3, the openings 24, 26 are preferably relatively closely adjacent the lower end of the tubular member 18 so that they can be brought into position in alignment with the open portion of the loop 12*a*. This allows the fastener 22 to be inserted into the openings 24, 26 and pass through the loop 12*a* to locate and support the tubular guard member.

A desirable aspect of the subject invention is the preferred design for the fastener member 22. This can best be seen and understood by reference to FIGS. 3 through 6. As shown therein, the fastener 22 preferably has an elongated pin-like body 28 of generally cylindrical configuration and of a length that is significantly greater than the maximum diameter of the tubular member 18. The fastener 22 can be formed from a variety of materials but is preferably formed from a relatively tough high-strength plastic or resilient resinous material such as nylon or high-density polyethylene, for example. The fastener 22 has enlarged head portions formed at its opposite terminal ends. A first head portion 30 is sized and arranged so as to be incapable of being passed through the openings 24, 26. This enlarged end portion or head serves as a stop during insertion of the pin through the openings and the loop 12*a*. At the opposite end, there are preferably a pair of enlarged head portions 32, 34. Each of the enlarged head portions 32, 34 have a generally truncated conical configuration.

The head portions 32, 34 are arranged so they are radially collapsible for insertion through the openings 24, 26. In the subject embodiment, this radial collapsibility is provided by an elongated central through slot 36 which is formed completely through the pin member 28 adjacent the end as shown. Note that the opening 36 extends completely through the pin in the area of the maximum diameters of the heads 32, 34. This allows inward collapsing movement of the heads during an insertion operation. However, the natural resiliency of the material from which the pin is formed causes the heads to return to the expanded position shown.

The use of the double head arrangement with the two enlarged portions 32, 34 offers certain significant advantages to the fastener 22. In particular, referring to FIG. 6, it will be seen that the first head portion 32 can be inserted through the opening 24 to a premount or preassembly position as shown therein. In this position, the fastener 22 is engaged in the opening 24 but only to the extent of the intermediate space between the head enlargements 32, 34. This maintains the fastener out of the mid-portion or center of the tubular member 18 to a location wherein the pin will not interfere significantly with the mounting of the tubular member 18 about the guy-wire 12 or interfere with its movement to a position wherein the openings 24, 26 are aligned with the loop 12*a* so that the pin can then be moved to its final located position by being manually driven through the loop 12*a* and the second aligned opening 26. Additionally, when the pin or fastening member 22 is moved to its final assembled position as shown in FIGS. 3 and 4, the head 32, 34 can be moved completely through opening 26 with either head portion 32 or both head portion 32 and head portion 34 extending through the opening 26. This thus provides a degree of adjustability for the clamping or locking of the tubular member to the lower end of the guy-wire loop 12*a*. More head portions could, of course, be provided to allow greater adjustability if desired.

Figure 6:
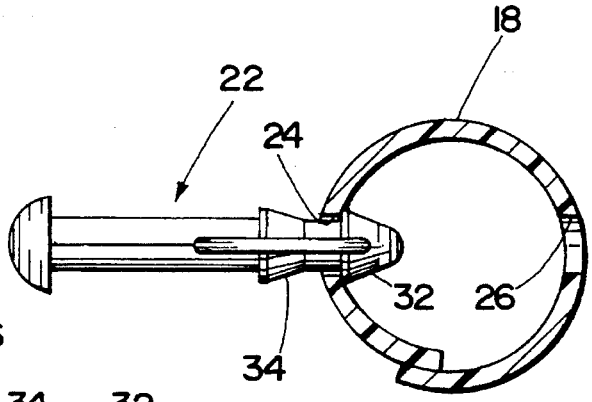

As can be appreciated, the entire installation and affixing of the guard member to the guy-wire can take place rapidly without the use of any additional tools or other components. Moreover, the entire guard assembly can be provided in a single semi-assembled relationship as shown in FIG. 6 with the fastener pre-installed and ready to use.

Figure 5:
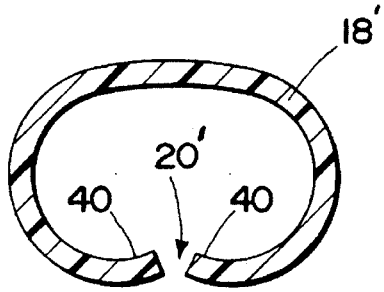
FIG. 5 is a cross-sectional view through a tubular guard member showing a second embodiment of the invention; and, FIG. 6 is a cross-sectional view through the guard assembly of FIG. 1 prior to its installation on the guy-wire.

FIG. 5 shows an alternative configuration for the tubular member 18. As shown therein, the member 18' can have the slot 20 formed so that it is spaced apart and provided with inwardly directed edge portions 40 so as to in effect form an entry guide for the slot 20. This in some ways facilitates the mounting of the guard tube to the guy-wire cable.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A guard assembly for use on a guy-wire of the type having an end terminating in a loop, said guard assembly comprising:

an elongated tubular member of a relatively rigid plastic having a hollow interior throughout its length and terminating in first and second open opposite ends, said tubular member having a single split extending longitudinal thereof between the opposite ends to allow the tubular member to be installed in surrounding relationship to a guy-wire by being moved laterally thereover with the guy-wire entering the hollow interior through the split;

first and second generally diametrically opposed aligned apertures located adjacent the first end of the tubular member; and, an elongated pin-like fastener extending through the first aperture and having first and second enlarged heads at opposite ends thereof with the first head comprising first and second enlarged portions spaced to permit the first enlarged portion to be located within the hollow interior of the tubular member and the second enlarged portion to be located exteriorly of the tubular member, both said first and second enlarged portions being radially compressible to a size to allow the first head to be selectively passed through the second aligned opening, the second head being of sufficient size to prevent its passage through the aligned openings and said first and second enlarged portions of said first head each having a tapered shape to facilitate insertion through the apertures and having shoulder means to prevent withdrawal after insertion through the apertures.

2. A guard assembly as defined in claim 1 wherein the fastener is a molded plastic one piece structure with the first head including a longitudinally extending slot extending therethrough.

* * * * *